United States Patent [19]

Albrecht

[11] 4,085,558

[45] Apr. 25, 1978

[54] METAL CELLULAR DECKING SECTION AND METHOD OF FABRICATING THE SAME

[75] Inventor: Raymond E. Albrecht, Sewickley, Pa.

[73] Assignee: H. H. Robertson Company, Pittsburgh, Pa.

[21] Appl. No.: 804,735

[22] Filed: Jun. 8, 1977

Related U.S. Application Data

[63] Continuation-in-part of Ser. No. 696,517, Jun. 16, 1976, abandoned.

[51] Int. Cl.[2] ..... E04F 12/04; E04B 5/23

[52] U.S. Cl. ..... 52/451; 52/674; 52/672; 52/630; 29/6.1; 29/155 R; 29/460

[58] Field of Search ..... 52/450–454, 52/670–675, 329, 334, 336, 630; 29/155 R, 6.1, 460, 455 LM

[56] References Cited

U.S. PATENT DOCUMENTS

| | | | |
|---|---|---|---|
| 460,850 | 10/1891 | Curtis | 52/674 |
| 982,291 | 1/1911 | Myers | 52/672 |
| 1,017,255 | 2/1912 | Forsyth | 52/671 |
| 1,073,906 | 9/1913 | Kahn | 52/672 |
| 1,508,050 | 9/1924 | Carroll | 52/674 |
| 1,561,518 | 11/1925 | Graham | 52/363 |
| 1,664,247 | 3/1928 | Dean | 29/6.1 |
| 1,795,493 | 3/1931 | Kessler | 29/6.1 |
| 1,864,598 | 6/1932 | Kessler | 29/6.1 |
| 1,941,211 | 12/1933 | Inglee | 52/329 |
| 2,167,208 | 7/1939 | Hilpert | 52/333 |
| 2,200,636 | 5/1940 | Palmer | 52/293 |
| 2,213,603 | 9/1940 | Young et al. | 52/344 |
| 2,357,560 | 9/1944 | Taforo | 52/145 |
| 3,034,197 | 5/1962 | Watanabe | 29/6.1 |
| 3,394,514 | 7/1968 | Lindner | 52/336 |
| 3,812,636 | 5/1974 | Albrecht et al. | 52/450 |

*Primary Examiner*—James L. Ridgill, Jr.
*Attorney, Agent, or Firm*—Harry B. Keck; George E. Manias

[57] ABSTRACT

A metal cellular decking section comprising a fluted upper element and a lower element secured to the upper element along contiguous portions thereof. At least one longitudinally extended expanded metal zone is provided in the lower element. The upper element may include a formation defining a channel which extends parallel with the expanded metal zone and which presents an opening adjacent to the expanded metal zone. In the present metal cellular decking section, the expanded metal zone promotes mechanical bonding of subsequently applied fireproofing material to the underside of the lower element; increases the coverage width for a given steel girth; and provides access to the channel for attachment of hanger means. A method of fabricating the present metal cellular decking section is disclosed.

20 Claims, 22 Drawing Figures

A
SLITTING
B
EXPANDING
C
LEVELING
D
ASSEMBLING
E
SECURING
F
RECOVERING PRODUCT 120
112
54
42
116
118
114
52

54
122
120
128
42
60
58
116
126
124
118
52

130
42
120
58
60
116
118
58

130
46
40
60
42

136
40
132
136
42
134

82
82
82
60

METAL CELLULAR DECKING SECTION AND METHOD OF FABRICATING THE SAME

CROSS-REFERENCES TO RELATED APPLICATIONS

This application is a continuation-in-part of copending application Ser. No. 696,517 filed June 16, 1976 now abandoned.

BACKGROUND OF THE INVENTION

1. Field of the Invention

This invention relates to metal cellular decking sections useful in the construction of building floors and method of fabricating the same, and more particularly to decking sections having means promoting mechanical bonding of subsequently applied fireproofing material and providing access to the channels for attachment of hanger means.

2. Description of the Prior Art

Metal cellular decking sections are used extensively in the construction of building floors. The decking sections extend between horizontal support beams and support an overlying layer of concrete. The decking sections also provide longitudinal cells serving as raceways for the distribution of various electrical services. To improve the fire-resistant characteristic of the floor structure, fireproofing has been provided on the bottom face of the decking sections. Field spraying of the fireproofing material to the undersurface of the decking sections is a common method of applying such fireproofing. Regardless of the method of application, one difficulty encountered during fire tests of such flooring structures is fireproofing fall-off. One reason proposed for such fireproofing fall-off is the lack of mechanical anchorage for the sprayed material.

Many methods have been proposed to promote mechanical locking between plaster, cementitious fireproofing and other settable material and a substrate. Such use of flat and fluted expanded metal lath is well-known, see for example U.S. Pat. Nos. 1,017,255; 2,167,208; 2,213,603. Such use of perforated elements such as sheets, cellular sections and non-cellular sections also is well-known, see for example U.S. Pat. Nos. 460,850; 2,200,636; 2,357,560. Such use of stud-like elements also is known, see for example U.S. Pat. No. 1,561,518.

The use of field applied stud-like elements and expanded metal lath is a time-consuming and expensive method of promoting mechanical locking of the subsequently applied fireproofing material. The use of perforations to promote mechanical locking cannot be considered inasmuch as the longitudinal cells, to serve as electrical raceways, must be substantially imperforate.

Decking sections having keystone-like ribs and the use of such ribs as attachment sites for hanger devices is known in the art, see for example U.S. Pat. No. 3,812,636. However, keystone-like ribs can only be used as attachment sites for hanger devices, where the keystone-like ribs are provided in non-cellular decking sections.

Many methods of manufacturing expanded metal lath are known in the art. One method of manufacturing expanded steel truss members is disclosed in U.S. Pat. No. 3,034,197.

SUMMARY OF THE INVENTION

The principal object of this invention is to provide a metal cellular decking section having means promoting mechanical bonding of fireproofing material to the undersurface of the decking section.

Another object of this invention is to provide a metal cellular decking section wherein the lower element, prior to assembly, is laterally expanded to form at least one expanded metal zone — to lateral expansion providing a greater coverage width for a given steel girth and a savings of steel.

Still another object of this invention is to provide a metal cellular decking section having an upstanding keystone-like rib presented in a valley of the corrugated upper element and having at least one expanded metal zone in the lower sheet which provides access to the interior of the rib for attachment of hanger devices.

A further object of this invention is to provide an improved building floor structure incorporating metal cellular decking sections of this invention.

A still further object of this invention is to provide a novel method of manufacturing the present metal cellular decking section.

The present invention provides a metal cellular flooring section of the type providing one or more enclosed cells. The decking section may comprise a corrugated upper metal sheet presenting at least one crest, plural valleys and webs connecting each valley to the crest; and a correlative lower metal sheet secured to the upper metal sheet along contiguous portions thereof and cooperating therewith to define at least one enclosed cell. Alternatively, the decking section may comprise an integral corrugated upper metal sheet presenting plural crests and plural valleys and webs connecting adjacent ones of said crests and valleys, and a correlative lower metal sheet secured to the upper metal sheet along contiguous portions thereof and cooperating therewith to define parallel enclosed cells separated by the valleys.

In accordance with the present invention, the lower metal sheet is provided with at least one expanded metal zone formed integrally therewith and extending longitudinally of the decking section beneath one of the valleys.

Further in accordance with the present invention, a valley of the upper metal sheet includes a formation extending thereabove defining an interior channel accessible through the expanded metal zone. The subsequently applied fire-proofing material in addition to being mechanically bonded to the expanded metal zone, extends into the interior channel and is thereby further bonded to the decking section. Preferably, the formation comprises an upstanding rib formed in the valley and extending longitudinally thereof. The rib may comprise a base vertically spaced-apart from the valley and reverse-bent sidewalls converging from the base toward the valley. The lower ends of the reverse-bent sidewalls are spaced-apart to define an opening providing an access to the interior channel thereof.

The present invention also provides improvements in a building floor structure of the type comprising a metal subfloor, an overlying layer of concrete supported by the metal subfloor, and a layer of fireproofing material applied to the lower surface of the subfloor. The metal subfloor incorporates a plurality of the metal cellular decking sections of this invention and presents plural expanded metal zones. The fireproofing material envelops and is mechanically bonded by the expanded metal zones.

The present invention also provides improvements in the method of manufacturing a metal cellular decking section wherein a corrugated upper metal sheet presenting crests and valleys separated by inclined webs, is secured to a correlative lower metal sheet along contiguous portions thereof and cooperates therewith to define parallel enclosed cells. In accordance with the present invention, that method includes the steps of forming spaced-apart parallel rows of staggered slits in at least one longitudinally extending narrow zone of the lower metal sheet; expanding the thus slitted lower metal sheet laterally thereby providing an expanded metal zone presenting an expanded metal pattern and unexpanded metal segments on opposite sides of the zone; assembling the upper metal sheet in superposed relation with the thus expanded and previously slitted lower metal sheet by placing the expanded metal zone directly beneath one of the valleys; and securing the thus expanded and previously slitted lower metal sheet to the valleys of the upper metal sheet. Preferably, the lower metal sheet is secured to the valleys of the upper metal sheet by welding at locations on opposite sides of the expanded metal zones.

Where the expanded metal pattern extends above and/or below the opposite faces of the lower metal sheet, and present method may include the step — prior to assembly and after expansion — of leveling the expanded metal pattern of each zone to render the same substantially flush with the unexpanded segments of the lower metal sheet.

DESCRIPTION OF THE PREFERRED EMBODIMENTS

Figure 1:
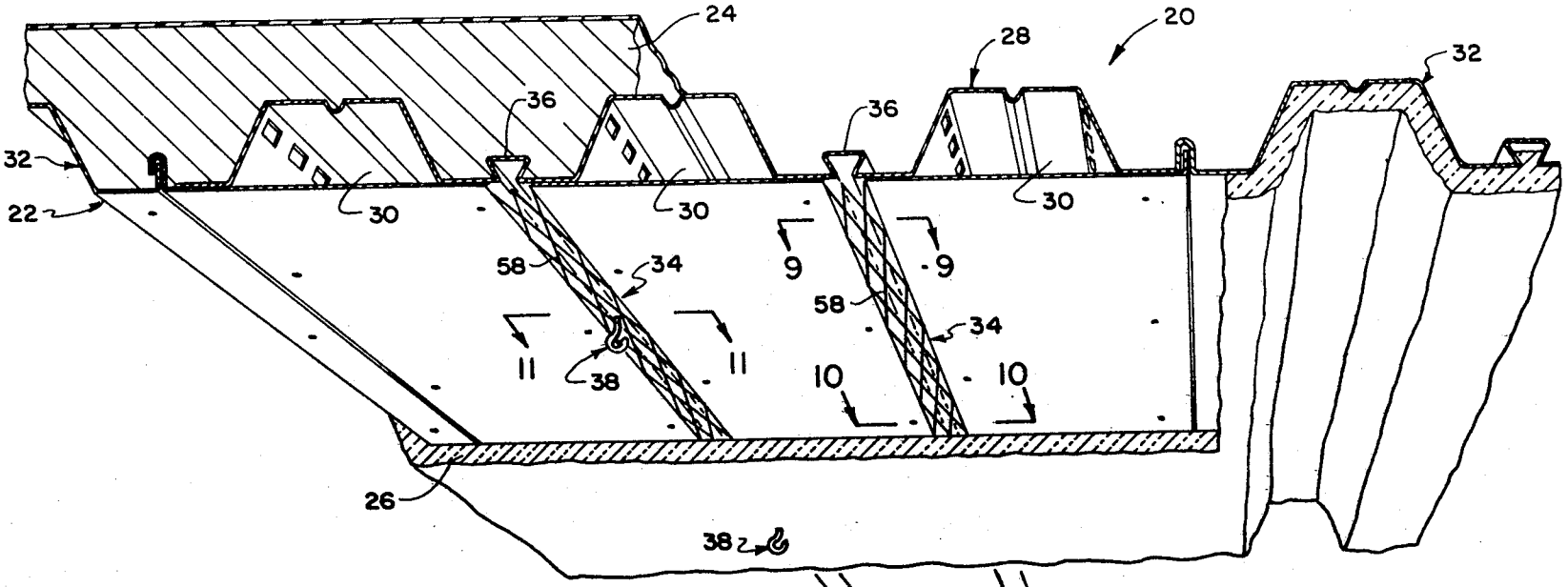
FIG. 1 is a fragmentary isometric view of a building floor structure incorporating the flooring sections of FIGS. 2 and 3.

FIG. 1 illustrates a floor structure 20 comprising a metal subfloor 22 covered by a layer of floor fill, such as concrete 24. A layer of fireproofing 26 is applied to the undersurface of the metal subfloor 22. The metal subfloor 22 includes metal cellular decking sections 28 providing plural, generally parallel, enclosed cells 30. The cellular decking sections 28 are comingled with metal non-cellular decking sections 32 in a preselected pattern to allow for present and future distribution of electrical services throughout the floor structure 20. Each of the decking sections 28 includes bond promoting means 34 for promoting mechanical bonding of the fireproofing material 26 to the undersurface of the decking section 28. The decking section 28 additionally includes formations 36 which cooperate with the means 34 to further promote mechanical bonding of the fireproofing material 26. The formations 36 additionally provide anchor sites for hanger devices 38 from which ceilings, sprinkler piping and other mechanical equipment are suspended; and provide keying recesses for resisting vertical disengagement of the concrete slab 24 from the decking section 28.

Figure 2:
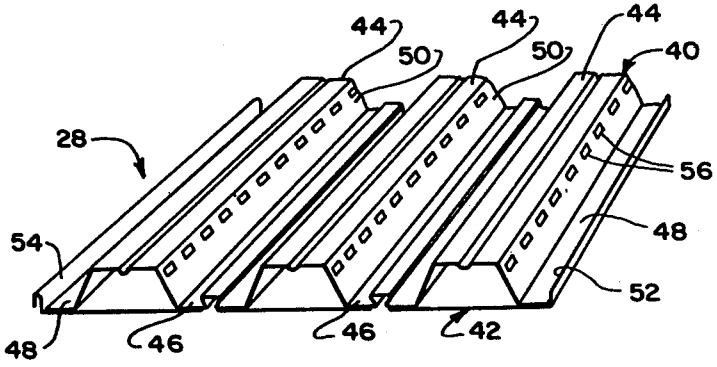
FIG. 2 is a fragmentary isometric view of the present metal cellular decking section.

Referring to FIG. 2, the decking section 28 may comprise an integral corrugated upper metal sheet 40 and a correlative, substantially flat, lower metal sheet 42. The upper metal sheet 40 presents plural crests 44, plural valleys including intermediate valleys 46 and lateral valleys 48 on opposite sides of the decking section 28, nd webs 50 connecting adjacent ones of the crests 44 and valleys 46, 48. The correlative lower metal sheet 42 is secured to the upper metal sheet 40 along contiguous portions (e.g., the valleys 46, 48) thereof and cooperate therewith to define the parallel, enclosed cells 30. Marginal connecting means, such as the male lip 52 and the female lip 54 are provided along the opposite longitudinal edges of the flat lower sheet 42. Each of the webs 50 may be provided with deformations 56 which serve as hold-down means for resisting vertical disengagement of the concrete slab 24 (FIG. 1) from the decking section 28; and as shear-resisting means for resisting movement of the concrete slab 24 longitudinally of the decking section 28.

Figure 3:
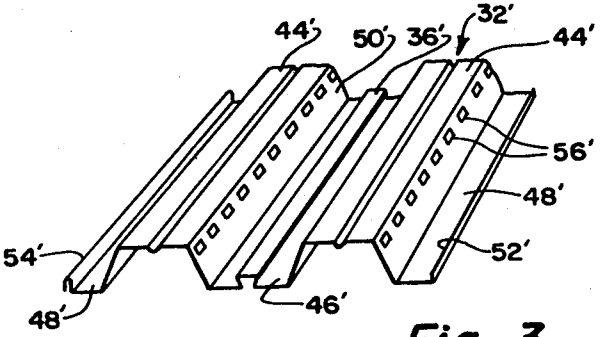
FIG. 3 is a fragmentary isometric view of a companion non-cellular metal decking section.

Referring to FIG. 3, the metal non-cellular decking section 32 is similar to the upper corrugated sheet 40 (FIG. 2) and corresponding primed numerals are employed to identify corresponding parts heretofore described. The decking section 32 differs from the upper metal sheet 40 in having only two crests 44′ and one intermediate valley 46′. The male and female lips 52′, 54′ are formed along the lateral valleys 48′.

In accordance with the present invention, the bond promoting means 34 (FIG. 1) comprises expanded metal 58 formed integrally in and along zone 60 of the lower metal sheet 42. The lower metal sheet 42 (FIG. 4) has spaced-apart parallel rows of staggered slits 64, 66 formed therein in each of plural narrow zones 62 which extend longitudinally thereof. The slits 64, 66 may be formed by any of the well-known slit forming operations. The slits 64, 66 define latticed members 68 which are joined, as shown, by connecting segments 70. The lower metal sheet 42 is then expanded (FIG. 5) during which the expanded metal pattern 58 is formed.

Figure 6:
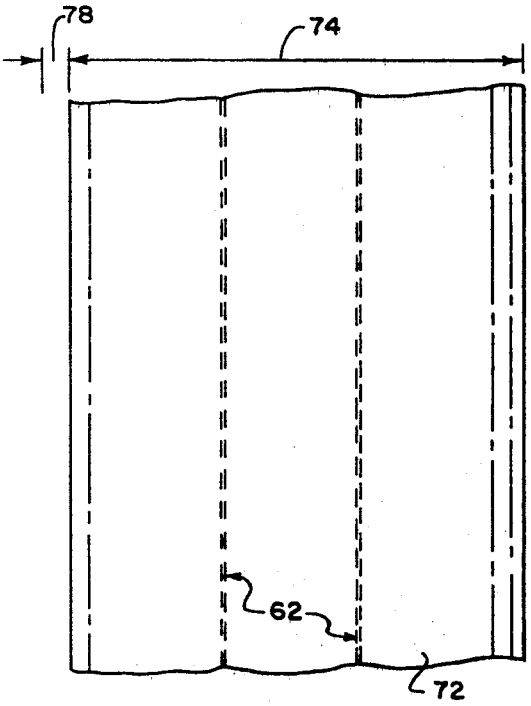
FIG. 6 is a fragmentary plan view of the lower element of the decking section of FIG. 1 prior to expansion.
Figure 7:
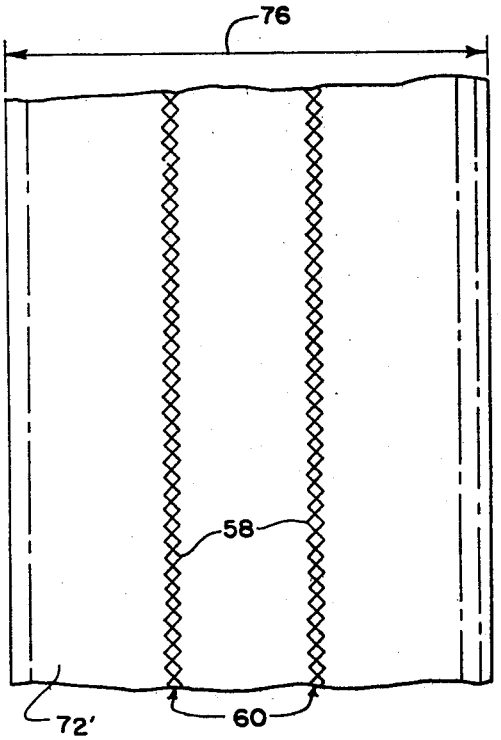
FIG. 7 is a fragmentary plan view of the lower element of FIG. 6 after expansion.

FIG. 6 illustrates a strip 72 of sheet metal which is to be formed into the lower metal sheet 42 — the strip 72 of sheet metal having a width indicated by the dimension line 74. After slitting along plural zones 62 (FIG. 6) and after expansion (FIG. 7) the strip 72' of sheet metal presents a width indicated by the dimension line 76. It will be observed by comparing FIGS. 6 and 7 that the initial width 74 of the strip 72 has been increased during expansion by an increment 78. Consequently, the advantages arising out of lateral expansion of the strip 72 are two-fold. That is, the lateral expansion provides a greater coverage width — the width 76 (FIG. 7) — for a given steel width — the width 74 (FIG. 6). Moreover, by increasing the coverage width of the narrower strip 72, a savings (increment 78) in sheet metal material is realized.

Figure 4:
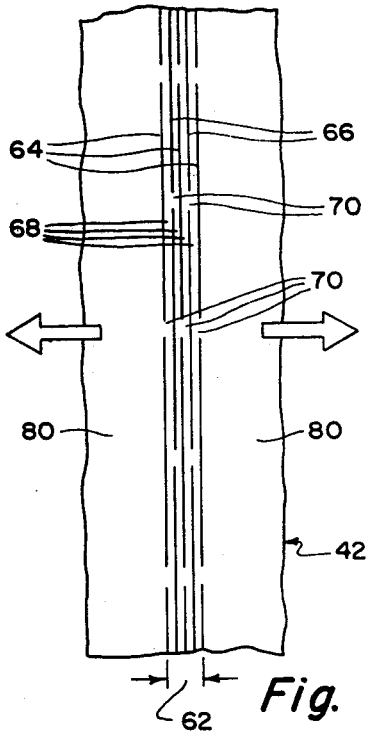
FIG. 4 is a plan view of a fragment of the lower metal sheet used in the decking section of FIG. 1, illustrating the slit pattern before expansion of the slitted member.
Figure 5:
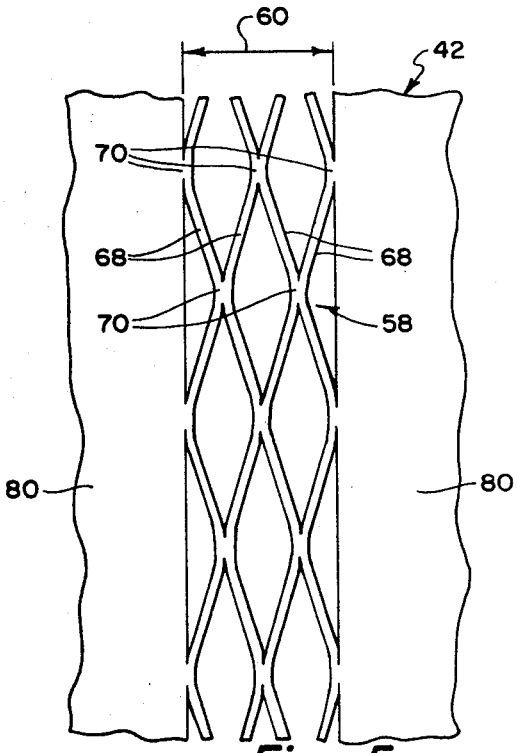
FIG. 5 is a plan view of the lower element of the decking section of FIG. 4 after expansion.
Figure 8:
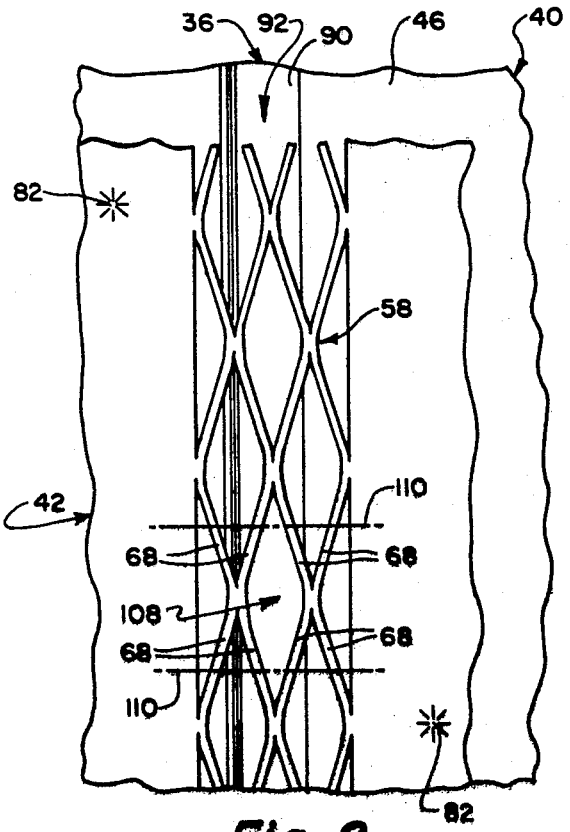
FIG. 8 is a fragmentary bottom view of the metal decking section of FIG. 1 in the region of an expanded metal zone.

Reverting to FIGS. 4 and 5, it will be appreciated that during the slit forming operation, the latticed members 68 may be displaced out of the upper and lower surfaces of the lower metal sheet 42. Consequently, the expanded metal pattern 58 (FIG. 5) must be flattened to render the same flush with the unexpanded lateral segments 80 of the lower metal sheet 42. As shown in FIG. 8, the lower metal sheet 42 is secured to the valleys 46 of the upper metal sheet 40 by, for example, spot welds 82 preferably located on opposite sides of the expanded metal pattern 58.

Figure 9:
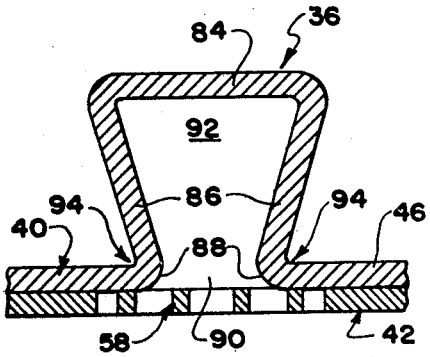
FIG. 9 is a fragmentary cross-sectional view taken along the line 9—9 of FIG. 1.

Referring to FIG. 9, each of the formations 36 preferably comprise ribs including a base 84 which is vertically spaced-apart from the valley 46, and reverse-bent sidewalls 86 having lower edges 88 adjoining the valley 46. The reverse-bent sidewalls 86 converge from the base 84 toward the valley 46. The lower edges 88 are spaced-apart and define a longitudinal opening 90 which affords access to the interior channel 92 defined by the base 84 and the sidewalls 86. It will be observed in FIGS. 9 and 10 that each of the reverse-bent sidewalls 86 cooperates with the contiguous valley 46 to define a longitudinal keying recess 94. The keying recess 94 resists vertical disengagement of the concrete slab 24 (FIG. 10) from the decking section.

Figure 10:
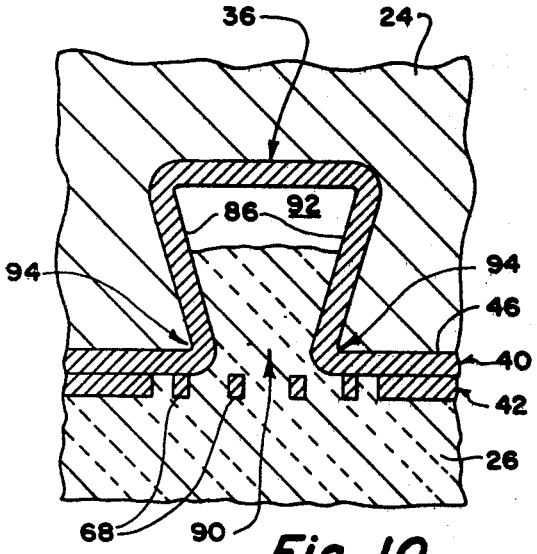
FIG. 10 is a fragmentary cross-sectional view taken along the line 10—10 of FIG. 1.

Referring to FIGS. 8 through 10, the lower metal sheet 42 is secured to the valley 46 of the upper metal sheet 40 such that the expanded metal pattern 58 resides directly beneath and extends parallel with the formation 36. The arrangement is such that the fireproofing material (FIG. 10) on application envelops the latticed members 68 thereby promoting mechanical bonding of the fireproofing material 26 to the undersurface of the decking section. In addition, the fireproofing material 26 is introduced through the opening 90 into the interior channel 92 of the formation 36 thereby being further mechanically bonded to the undersurface of the decking section.

Figure 11:
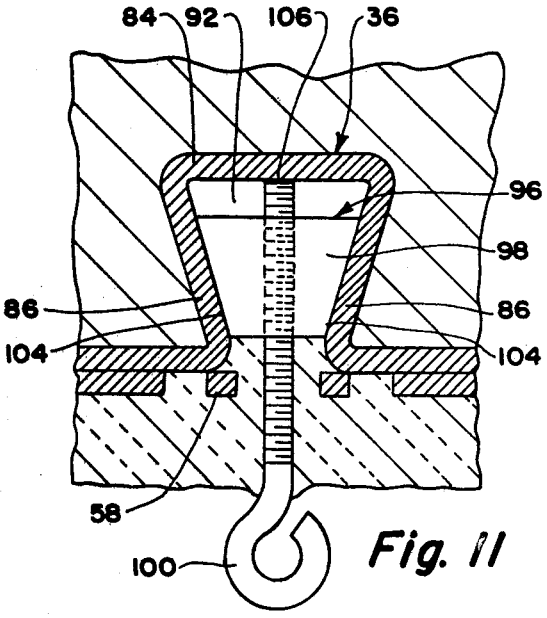
FIG. 11 is a fragmentary cross-sectional view taken along the line 11—11 of FIG. 1.
Figure 12:
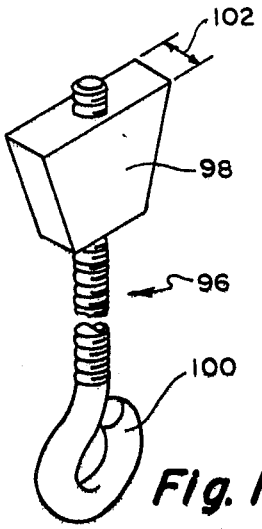
FIG. 12 is an isometric view of typical hanger means.

It will be appreciated that the expanded metal pattern 58 also provides access to the interior channel 92 for attachment of a hanger device — such access being heretofore available only in metal non-cellular decking sections. Typical hanger means 96 is illustrated in FIGS. 11 and 12. The hanger means 96 may comprise, for example, a conventional keybolt hanger comprising a head portion 98 and a suspension element such as an eyebolt 100 which is threadedly engaged with the head portion 98. The head portion 98 has a relatively narrow width 102 (FIG. 12) which is less than the width of the opening 90 (FIG. 9) of the formation 36. The arrangement is such that the head portion may be inserted through the opening 90 into the interior channel 92. Thereafter the head portion is rotated 90° so as to bring the converging opposite faces 104 (FIG. 11) into engagement with the reverse-bent sidewalls 86. It will be appreciated that with the end 106 of the eyebolt engaged with the base 84 of the formation 36, rotation of the eyebolt 100 causes the opposite faces 104 of the head portion to be urged into tight engagement with the sidewalls 86. The head portion is thus rigidly secured within the interior channel 92.

The expanded metal pattern 58 (FIG. 8) presents eye-shaped central openings 108 the size of which may be sufficient to pass the head portion 98 of the hanger means 96 (FIG. 12). Should this not be the case, the latticed members 68 may be clipped along the cut lines 110 and a segment of the expanded metal pattern 58 removed, thereby to provide an opening large enough to pass the head portion 98 of the hanger means 96.

The present invention also provides improvements in the method of manufacturing a metal cellular decking section wherein an integral corrugated upper metal sheet presenting plural crests and plural valleys separated by webs is secured to a correlative lower metal sheet along contiguous portions thereof and cooperates therewith to define parallel enclosed cells. The present method is diagrammatically illustrated in FIG. 13 to which reference is now directed. The present invention provides the steps in the above method of A. forming spaced-apart parallel rows of staggered slits in at least one longitudinally extending, narrow zone of said lower metal sheet;

B. expanding the thus slitted lower metal sheet laterally thereby providing an expanded metal zone presenting an expanded metal pattern, and unexpanded metal segments on opposite sides of each zone;

D. assembling the upper metal sheet in superposed relation with the thus expanded and previously slitted lower metal sheet by placing the expanded metal zone directly beneath one of said valleys;

E. securing the thus expanded and previously slitted lower metal sheet to the valleys of said upper metal sheet; and F. recovering a metal cellular decking section in accordance with the present invention. Where the resulting expanded metal pattern extends above and/or below the opposite faces of the lower metal sheet, the present method may include the step — prior to assembly and after expansion — of C. leveling the thus expanded and previously slitted lower metal sheet to flatten the expanded metal pattern of the zone and thereby render the same substantially flush with the unexpanded segments of the lower metal sheet.

Figures 13, 13A, 13B, 13C, 13D, 13E, 13F:
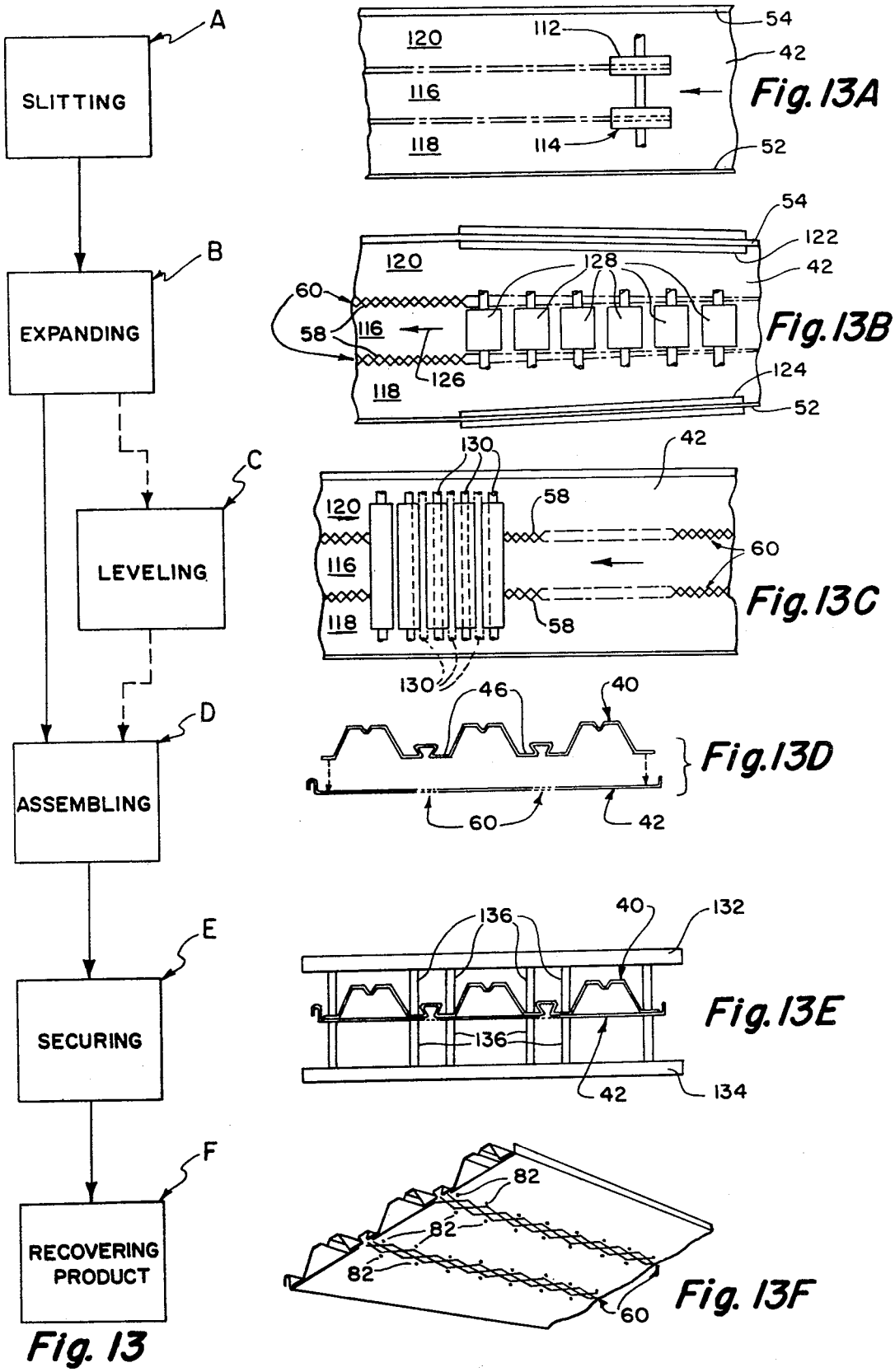
FIG. 13 is a block diagram illustrating the method of fabricating the metal cellular decking section of this invention.
FIGS. 13A to 13F are views schematically illustrating the method of FIG. 13.

Steps A through F of FIG. 13 also are schematically illustrated in FIGS. 13A through 13F, respectively. It should be noted that the following description concerns, specifically, the fabrication of the lower metal sheet 42 of the metal cellular decking section 28 of FIG. 2. That is the lower metal sheet 42 having two zones 60 of expanded metal pattern 58. It should be evident, however, that the present method may be employed to fabricate a lower metal sheet having one or more expanded metal znones at any location across the sheet width, for use in simple cell as well as multiple cell decking sections.

Referring to FIG. 13A, the lower metal sheet 42 may be slitted by two sets 112, 114 of opposed upper and lower slitting rolls (only the upper rolls being visible) along two zones. As a result of the slitting operation there is produced a central segment 116 and two lateral segments 118, 120, one on each side of the central segment 116. For the purpose of explanation, the segments 116, 118 and 120 will hereinafter be referred to as "unexpanded segments " to distinguish them from the expanded metal zones which are subsequently formed.

Referring to FIG. 13B, the thus slitted lower metal sheet 42 is then laterally expanded thereby providing two expanded metal zones 60 each presenting an expanded metal pattern 58. The lower metal sheet 42 may be expanded, for example, by engaging the male and female lips 52, 54 with diverging guide rails 122, 124, respectively, while moving the sheet in the direction of the arrow 126. During expansion, sets 128 of opposed upper and lower clamping rolls (only the upper rolls being visible) firmly grip the central unexpanded segment 116 and restrain the same from movement in a lateral direction.

Referring to FIG. 13D, the upper metal sheet 40 is then assembled in superposed relation with the expanded and slitted lower metal sheet 42 by placing each of the expanded metal zones 60 directly beneath one of the valleys 46 of the upper metal sheet 40.

Referring to FIG. 13E, the expanded and slitted lower metal sheet 42 is then secured to the valleys 46 of the upper metal sheet 40. The assembled upper and lower metal sheets 40, 42 may, for example, be introduced into conventional welding apparatus of the type comprising upper and lower platens 132, 134 presenting opposed electrodes 136. The welding or securing operation produces the staggered spot welds 82 best shown in the product illustrated in FIG. 13F. Preferably, the spot welds are made at locations on opposite sides of the expanded metal zones 60.

Where the resulting expanded metal pattern extends above and/or below the opposite faces of the lower metal sheet, the thus expanded and previously slitted lower metal sheet 42 is introduced into a series of upper and lower leveling rolls 130 (FIG. 13C) which operate to flatten the expanded metal pattern 58 of each zone 60 to render the same substantially flush with the unexpanded segments 116, 118, 120. Flattening of the expanded metal pattern 58 is required for two reasons. Namely, the expanded metal patterns must be flush with the upper surface of the lower metal sheet 42 so as not to interfere with securing the upper metal sheet 40 to the lower metal sheet 42. Moreover, the expanded metal patterns must be flush with the lower surface of the lower metal sheet 42 so as not to interfere with the welding of the decking section to the flanges of horizontal support beams.

Figure 14:
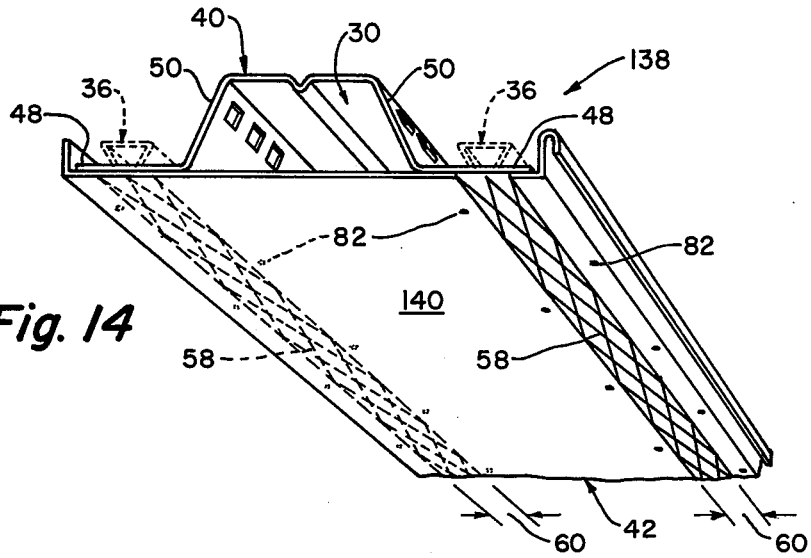
FIGS. 14 through 16 are fragmentary isometric views of alternative embodiments of the metal cellular decking section of this invention.
Figure 15:
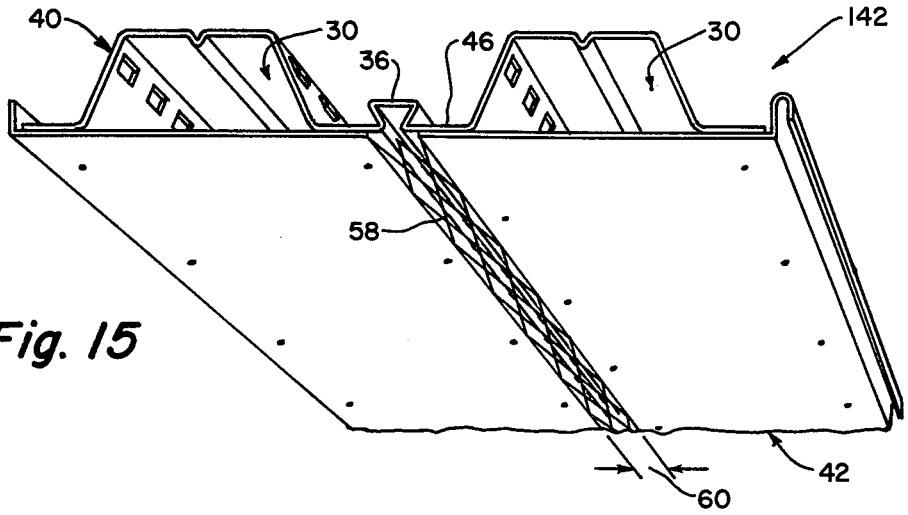
Figure 16:
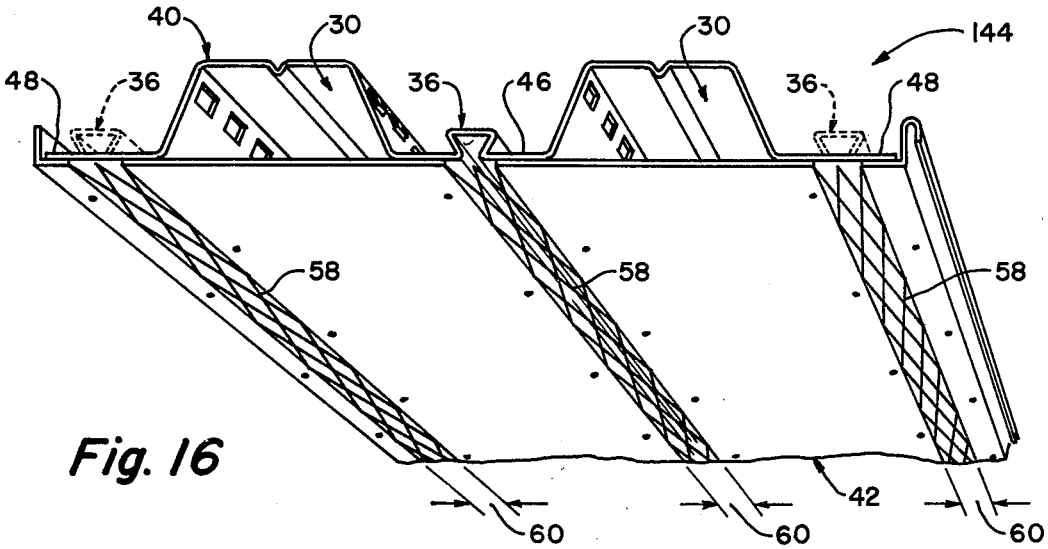

Alternative embodiments of the present metal cellular decking section are illustrated in FIGS. 14 through 16. Corresponding numerals will be employed to identify corresponding parts heretofore described.

FIG. 14 illustrates a decking section 138 assembled from an upper corrugated sheet 40 and a correlative substantially flat lower metal sheet 42 to provide a single enclosed cell 30. At least one expanded metal pattern 58 is formed integrally in the lower metal sheet 42 along a zone 60, and is disposed directly beneath one of the lateral valleys 48 of the corrugated upper metal sheet 40. A second expanded metal pattern 58 shown in dotted outline may be formed integrally in the lower metal sheet 42 along a second zone 60, directly beneath the opposite lateral valley 48. The unexpanded metal segment 140 extends beyond the webs 50 of the upper sheet 40 to maintain the closed periphery of the single cell 30. The lower metal sheet 42 is secured to the lateral valleys 48 of the upper metal sheet 40 by, for example, spot welds 82 preferably located on opposite sides of the expanded metal pattern 58.

FIG. 15 illustrates a decking section 142 assembled from a corrugated upper metal sheet 40 and a correlative substantially flat lower metal sheet 42 to provide a pair of enclosed cells 30. In this embodiment, a single expanded metal pattern 58 is formed integrally in the lower metal sheet 42 along the zone 60, directly beneath the intermediate valley 46 of the upper metal sheet 40.

FIG. 16 illustrates a decking section 144 wherein the lower metal sheet 42 is provided with three expanded metal patterns 58, positioned beneath each of the valleys 46, 48 of the upper corrugated metal sheet 40.

One or more of the valleys 46, 48 of the decking sections 138, 142, 144 may be provided with a formation 36 which cooperates with the subjacent expanded metal pattern 58 to further promote mechanical bonding of subsequently applied fireproofing material; and to additionally provide anchor sites for hanger devices as described above.

I claim:

1. A metal cellular decking section comprising:

an integral corrugated upper metal sheet presenting plural crests and plural valleys and webs connecting adjacent ones of said crests and said valleys;

a correlative lower metal sheet secured to said upper metal sheet along contiguous portions thereof and cooperating therewith to define parallel enclosed cells; and said lower metal sheet having at least one expanded metal zone formed integrally therein and extending longitudinally of said decking section beneath one of said valleys.

2. The metal cellular decking section of claim 1 wherein the width of said expanded metal zone is less than that of said one of said valleys.

3. The metal cellular decking section of claim 1 wherein said lower metal sheet is secured to said valleys at locations on opposite sides of said expanded metal zone.

4. The metal cellular decking section of claim 1 wherein said one of said valleys includes a formation extending thereabove defining an interior channel accessible through said expanded metal zone.

5. The metal cellular decking section of claim 4 wherein said formation comprises an upstanding rib formed in said valley and extending longitudinally thereof, said rib comprising a base vertically spaced-apart from the valley and reverse-bent sidewalls converging from said base toward said valley, said reverse-bent sidewalls having spaced-apart lower ends defining a lengthwise opening providing access to the interior channel thereof.

6. A building floor structure comprising a metal subfloor, an overlying layer of concrete supported by said metal subfloor, and a layer of fireproofing material applied to the lower surface of said subfloor;

said metal subfloor including metal cellular decking sections comprising an integral corrugated metal sheet presenting plural crests and plural valleys separated by webs, and a lower metal sheet secured to said upper metal sheet along contiguous portions thereof and cooperating therewith to define parallel enclosed cells; and said lower metal sheet having at least one expanded metal zone formed integrally therein and extending longitudinally of said decking section beneath one of said valleys, the fireproofing material of said layer enveloping said expanded metal zone and being mechanically bonded thereby to the undersurface of said lower metal sheet.

7. The floor structure of claim 6 wherein said one of said valleys includes a formation extending thereabove defining an interior channel accessible through said expanded metal zone, said fireproofing material extending into said interior channel and thereby being further mechanically bonded to the undersurface of said decking section.

8. The floor structure of claim 7 wherein said formation comprises an upstanding rib formed in said one of said valleys and extending longitudinally thereof, said rib comprising a base vertically spaced-apart from the valley and reverse-bent sidewalls converging from said base toward the valley and presenting spaced-apart lower ends defining a lengthwise opening providing access to the interior channel thereof.

9. The floor structure of claim 7 including a hanger device having an upper end captively retained in said interior channel and extending downwardly therefrom through the subjacent expanded metal zone.

10. In the method of manufacturing a metal cellular decking section wherein an integral corrugated upper metal sheet presenting plural crests and plural valleys separated by webs, is secured to a correlative lower metal sheet along contiguous portions thereof and cooperates therewith to define parallel enclosed cells, the steps of forming spaced-apart parallel rows of staggered slits in at least one longitudinally extending zone of said lower metal sheet;

expanding the thus slitter lower metal sheet laterally thereby providing an expanded metal zone presenting an expanded metal pattern, and unexpanded metal segments on opposite sides of said zone;

assembling the upper metal sheet in superposed relation with the thus expanded and slitted lower metal sheet by placing said expanded metal zone directly beneath one of said valleys; and securing the thus expanded and slitted lower metal sheet to the valleys of said upper metal sheet.

11. The method of claim 10 including the step, prior to assembly and following expansion, of:

leveling the expanded metal pattern of said zone to render the same substantially flush with said unexpanded metal segments of said lower metal sheet.

12. The method of claim 10 wherein said lower metal sheet is secured to said valleys by welding at locations on opposite sides of said expanded metal zone.

13. A metal cellular decking section comprising:

a corrugated upper metal sheet presenting at least one crest, laterally extending valleys and webs connecting each of said valleys to said crest;

a correlative lower metal sheet secured to said upper metal sheet along contiguous portions thereof and cooperating therewith to define at least one enclosed cell; and said lower metal sheet having at least one expanded metal zone formed integrally therein and extending longitudinally of said decking section beneath one of said valleys, the width of said expanded metal zone being less than that of said one of said valleys.

14. The metal cellular decking section of claim 13 wherein said lower metal sheet is secured to said valleys at locations on opposite sides of said expanded metal zone.

15. The metal cellular decking section of claim 13 wherein said one of said valleys includes a formation extending thereabove defining an interior channel accessible through said expanded metal zone.

16. The metal cellular decking section of claim 15 wherein said formation comprises an upstanding rib formed in said valley and extending longitudinally thereof, said rib comprising a base vertically spaced-apart from the valley and reverse-bent sidewalls converging from said base toward said valley, said reverse-bent sidewalls having spaced-apart lower ends defining a lengthwise opening providing access to the interior channel thereof.

17. A building floor structure comprising a metal subfloor, an overlying layer of concrete supported by said metal subfloor, and a layer of fireproofing material applied to the lower surface of said subfloor;

said metal subfloor including metal cellular decking sections comprising an integral corrugated metal sheet presenting at least one crest and plural valleys separated by webs, and a lower metal sheet secured to said upper metal sheet along contiguous portions thereof and cooperating therewith to define at least one enclosed cell; and said lower metal sheet having at least one expanded metal zone formed integrally therein and extending longitudinally of said decking section beneath one of said valleys, the fireproofing material of said layer enveloping said expanded metal zones and being mechanically bonded thereby to the undersurface of said lower metal sheet, the width of said expanded metal zone being less than that of said one of said valleys.

18. The floor structure of claim 17 wherein said one of said valleys includes a formation extending thereabove defining an interior channel accessible through said expanded metal zone, said fireproofing material extending into said interior channels and thereby being further mechanically bonded to the undersurface of said decking section.

19. The floor structure of claim 18 wherein said formation comprises an upstanding rib formed in said valley and extending longitudinally thereof, said rib comprising a base vertically spaced-apart from the valley and reverse-bent sidewalls converging from said base toward the valley and presenting spaced-apart lower ends defining a lengthwise opening providing access to the interior channel thereof.

20. The floor structure of claim 18 including a hanger device having an upper end captively retained in said interior channel and extending downwardly therefrom through the subjacent expanded metal zone.

* * * * *